United States Patent [19]

Hicks

[11] Patent Number: 4,662,256

[45] Date of Patent: May 5, 1987

[54] DIE SET

[75] Inventor: Charles D. Hicks, Warren, Mich.

[73] Assignee: Rochez Bros. Inc., Simsonville, S.C.

[21] Appl. No.: 733,033

[22] Filed: May 13, 1985

[51] Int. Cl.[4] ..... B21D 45/06

[52] U.S. Cl. ..... 83/124; 83/125; 83/136

[58] Field of Search ..... 83/124, 125, 123, 129, 83/136, 145

[56] References Cited

U.S. PATENT DOCUMENTS

| | | | |
|---|---|---|---|
| 3,111,053 | 11/1963 | Sevensson | 83/124 |
| 3,570,343 | 3/1971 | Wolnosky | 83/124 |
| 4,267,753 | 5/1981 | Bennett | 83/124 |

*Primary Examiner*—Donald R. Schran

*Attorney, Agent, or Firm*—Irvin L. Groh

[57] ABSTRACT

An improved die set for vertical stamping presses producing stamping. Knockout pins are replaceable from the upper end of the reciprocating shoe by movement of a bushing without requiring removal of the die and die retaining components which would require realignment.

7 Claims, 3 Drawing Figures

DIE SET

This invention relates to vertical punch presses, and more particularly to die sets for use in such presses for forming stampings.

The construction of a universal die set is described in U.S. Pat. No. 2,699,830 to Hugh M. Hodge. The Hodge patent shows an upper reciprocable die holding shoe and a lower fixed die holding shoe which together hold a plurality of exchangeable cooperating die elements. Typically the upper shoe holds a punch and a button die which cooperate with a compound blank punch and pierce die mounted on the stationary lower shoe to produce a stamping. A knockout located in the space between the button die and the punch in the upper reciprocating shoe serves to push the completed stamping away from the punch and button die by relative motion with respect thereto. In the foregoing Hodge patent this relative movement is provided by springs.

In most instances, a more positive force and motion is required to adequately actuate the knockout. This is provided on the upward retraction stroke of the press by the coaction of a knockout bar and spider through knockout pins which act against the upper end of the knockout. The knockout bar, retracting with the moving upper shoe, hits a stationary stop to drive the spider element downwardly moving knockout pins impacting the knockout.

While knockout pins provide effective part ejection force, uniformly distributed by the use of a number of equally spaced knockout pins, the knockout pin itself is the weak link in the system. Proper attention to knockout pin design is a requisite to efficient compound die operation. This problem is specifically addressed in a special report in "American Machinist/Metalworking Manufacturing", May 28,1962 issue, pages 103–118, page 105. Even with the best design, these knockout pins become worn and damaged and must be replaced. Replacement is a time consuming and tedious process requiring removal of the die set from the press and disassembly of the various die and die holding components, including realignment upon reassembly of the components.

Seemingly unrelated to the problem of replacing knockout pins is the ever present problem of compliance with government safety standards. OSHA standards require attachment of the upper shoe to the press by means other than the central shank extending upward from the upper shoe. Since this was the common mode of attachment, most older presses have the yoke or other collar attachment means, which availability can result in its use as the only attachment means.

This invention is directed to providing means to quickly replace knockout pins.

It is an object of this invention to provide such quick replacement without the need for realignment of die components.

It is a further object of this invention to eliminate attachment of the upper die shoe to the press by the use of a central shank on the upper shoe.

The foregoing purposes and objects of this invention are realized by the elimination of the central shank on the upper shoe. Access is provided for replacement of the knockout pins through the top of the die shoe. A unique bearing block or bushing is provided in the die set combination.

A new and improved die set is designed for attachment to the upper reciprocating assembly of a vertical stamping press for producing stamped products of uniform or irregular shape. The press has the usual frame mounting for a stationary die in the lower position and a reciprocating assembly holding an upper die member thereabove. The frame also has adjustable stop elements above the die member.

The die set has an upper shoe with means for rigidly attaching it to the reciprocating assembly. This attachment is usually by a plurality of cap screws. The upper shoe has a recess opening downwardly in its lower face, generally in line with the stationary member.

A die retainer is mounted on the lower face of the shoe with its central aperture in line with the shoe recess. A button die is removably mounted in the central aperture of the die retainer. A punch is removably mounted in the recess within the button die in axial alignment with the stationary die member. The punch has a cutting surface at its lower end and cylindrical body portion which extends upwardly above the button die. A punch retainer is mounted in the recess above the button die. The retainer has a bore in which the cylindrical body portion of the punch is located.

An annular stamp product knockout surrounds the punch in the space between the punch and the button die. A backing plate is mounted in the recess in contact with the upper surface of the punch retainer. A spider element is located in the recess above the backing plate having a radially extending contact portion and a shank portion which extends axially from the top of the upper shoe. In smaller sized die sets, this radially extending contact portion can be in the form of annular flange; however, in most instances it takes the form of a plurality of equally spaced radially extending arms. A plurality of knockout pins extend through holes in the punch retainer and the backing plate with their upper ends in contact with the contact portion of the spider element and their lower ends in contact with the top of the knockout. In the usual case where the spider element has a plurality of radially extending arms, these arms are circumferentially equally spaced and one of the knockout pins is in line with a corresponding one of the arms. The knockout pins have enlarged upper ends with a chamfer and the holes through the backing plate are chamfered on the top side of the plate to receive the pin chamfers.

A bushing is located on top of the shoe and the shank portion of the spider element extends upwardly into the bushing. A stop bar is slidably mounted in the ram or reciprocating assembly above the bushing in line with the spider shank. A knockout bar extends out of the bushing with its lower end in contact with the shank portion of the spider element and its upper end in contact with the stop bar. Adjustable stop elements on the frame limit the upper movement of the stop bar.

In operation, as the assembly is reciprocated in a stamping cycle, the knockout slides from a first position during the down stroke of the assembly where its lower end is withdrawn upwardly of the lower ends of the punch and the button die. During the upstroke of the assembly the stop bar contacts the frame stop elements to push the knockout bar against the spider element and the knockout pins against the top end of the knockout extending the knockout downwardly to a second position in which the lower end of the knockout extends beyond the lower ends of the punch and button die for separation of the stamped product from the button die and punch.

The improved die set provides the means for replacing the knockout pins after the upper shoe has been detached from the reciprocating assembly. The knockout bar is first lifted out of the bushing which keeps it aligned with the spider shank. The bushing is then lifted out of engagement with the spider shank so that the spider element can be removed from the recess and the knockout pins can be replaced by lifting them from above the backing plate through the recess. The replacement knockout pins are substituted and the upper shoe reassembled. This provides a unique structure for replacement of the knockout pins without removal of the die elements or retainers from the shoe which would necessarily require a realignment process.

The preferred embodiment of the invention is illustrated in the drawing in which:

FIG. 2 is a view taken along line 2—2 of FIG. 1 showing the lobed-shaped cavity formed in the upper end of the upper shoe to accommodate the radially extending arms of the spider element and the countersunk or chamfered holes in the backing plate to accommodate the knockout pins.

FIG. 3 is a view taken along line 3—3 of FIG. 1 showing the radially extending arms of the spider element.

Figure 1:
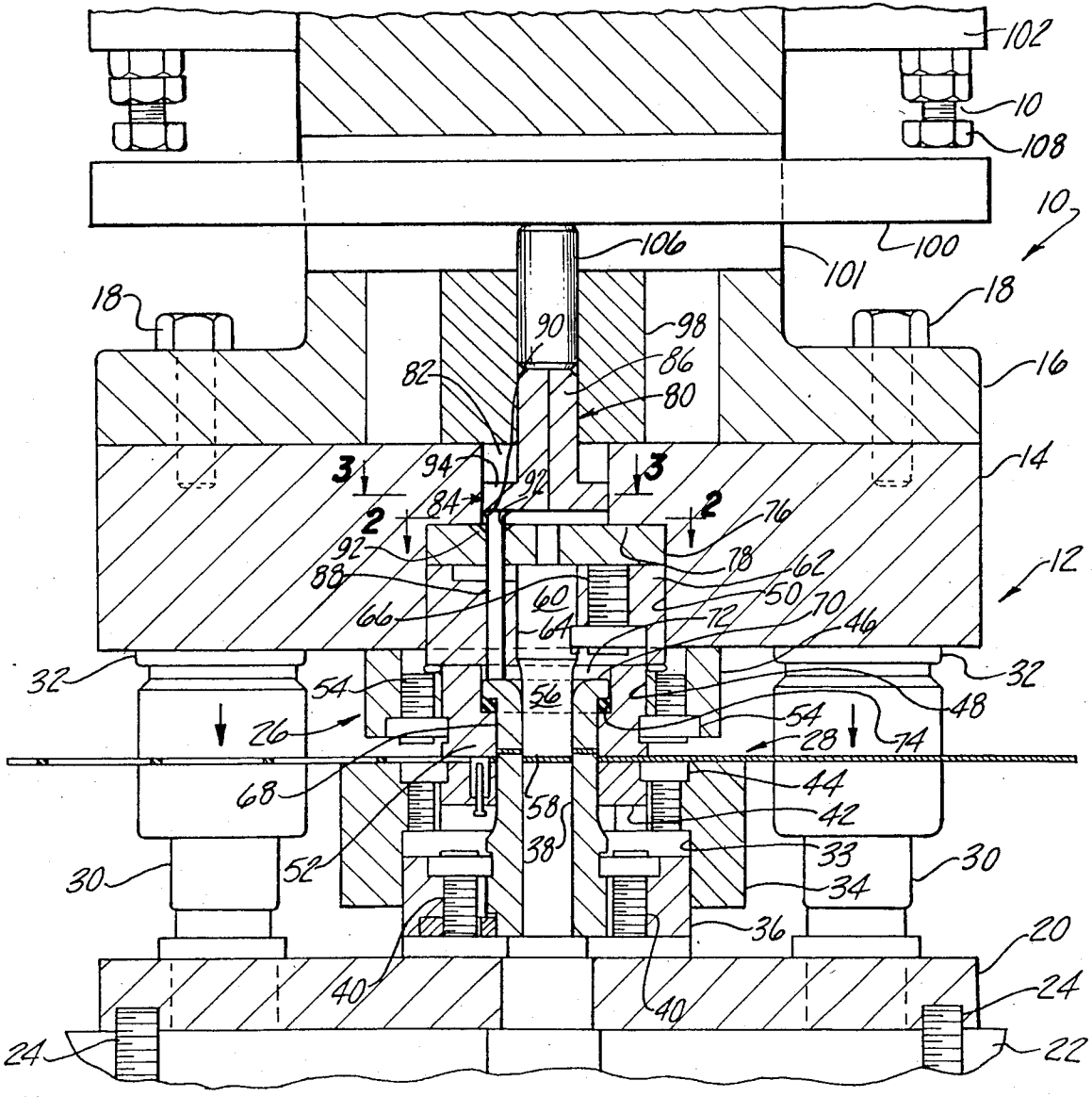
FIG. 1 is an elevational view in section of the die set and cooperating portions of the vertical press in which it has been installed.

Vertical stamping press 10 has die set 12 fixed in an operating position in which the upper shoe 14 is attached to the reciprocating assembly 16 by bolts 18, and similarly, the lower shoe 20 is attached to the lower fixed portion 22 of the press by bolts 24. The upper die assembly 26 is maintained in aligned position with the lower die assembly 28 by pins 30 affixed to the lower shoe 20 and slidingly received in bearings 32 attached to the upper shoe 14.

Associated with the lower shoe 20 is stripper block 34 which has a cylindrical recess 33 which houses compound die retainer 36. Stripper block 34 is held by bolts (not shown) to lower shoe 20 for limited vertical motion relative thereto. The stripper block is normally held in a raised position by a plurality of springs (not shown) acting between recesses in the stripper block 34 and lower shoe 20. A compound blank punch and pierce die 38 is held in compound die retainer 36 by lock screws 40 and extends through stripper block 34. The upper portion of the compound die 38 is surrounded by stripper insert 42 which is held in stripper block 34 by lock screws 44.

Die retainer 46 is mounted on the lower face of upper shoe 14 by screws and alignment pins (not shown). The central aperture 48 of die retainer 46 is aligned with compound die 38 and recess 50 in upper shoe 14. Button die 52 is removably mounted in central aperture 48 of die retainer 46 by lock screws 54. Punch 56 is removably mounted in recess 50 within button die 52 in axial alignment with the stationary compound die 38. Punch 56 has a cutting edge 58 at its lower end and a cylindrical body portion 60 extending upwardly above button die 52. Punch retainer 62 is mounted in recess 50 above the button die having a bore 64 in which the cylindrical body portion 60 of the punch 56 is located. Punch 56 is held in punch retainer 62 by lock screw 66 which engages a slot in cylindrical body portion 60.

An annular stamped product knockout 68 surrounds punch 56 in the space between the punch 56 and button die 52. Knockout 68 has an outwardly extending flange 70 at its upper end which is accommodated with a sliding fit in an upwardly extending cavity portion 72 of button die 52. A resilient member 74 is fitted over the lower end of knockout 68 so that it acts between flange 70 and button die 52 to retain knockout 68 in a normal position above the lower face of button die 52 and cutting edge 58 of punch 56. Backing plate 76 is mounted in recess 50 in contact with the upper surface of punch retainer 62. Upper wall 78 defines the upper end of the main body of recess 50 and acts to retain backing plate 76 from upward movement. Spider element 80 is mounted in the reduced area portion 82 of recess 50 above backing plate 76. Spider 80 has a radially extending contact portion 84 at its lower end and a shank portion 86 extending axially from the top of the upper shoe 14.

A plurality of knockout pins 88 extend through holes in punch retainer 62 and backing plate 76 with the upper ends of each pin in contact with radially extending contact portion 84 of spider element 80. The lower end of each pin is in contact with the top of flange 70 on knockout 68. Knockout pins 88 have a collar portion 90 with a chamfer on its lower side to engage a similar chamfer 92 on the holes passing through backing plate 76.

In smaller sized die sets the radially extending contact portion 84 of the spider element 80 is in the form of an annular flange. More commonly, this portion 84 takes the form of a plurality of equally spaced radially extending arms 94 equally spaced around the circumference of the spider with one arm in contact with each of the knockout pins 88. As seen in FIG. 3, three equally spaced arms 94 are provided on spider element 80. Preferably, with a small number of spider arms, the reduced recessed area 82 would be made in the form of lobes 96 to accommodate the spider arms 94, as shown in FIG. 2.

Extending above the upper shoe 14 is bushing 98 containing the upper end of spider shank 86. Stop bar 100 is mounted in slot 101 of reciprocating ram 16 above bushing 98 and in line with spider shank 86. The vertical position of stop bar 100 is limited by adjustment of stop nuts 104 and stop elements or bolts 108 affixed to frame 102. Knockout bar 106 extends out of the top of bushing 98 in line with and in contact with the shank portion 86 of spider element 80 and stop bar 100. Bushing 98 thus serves the purposes of aligning the spider element 80 with knockout bar 106 so that during the upward stroke of press 10 the upper end of knockout bar 106 being in contact stop bar 100 which hits stop elements 108 to translate downward motion to the knockout 68. Removal of bushing 98 during the disassembly process provides access to the upper die assembly for replacement of knockout pins 88 as set forth below.

In operation, as assembly 16 is reciprocated in a stamping cycle, knockout 68 slides from a first position during the downstroke of the assembly where its lower end is withdrawn upwardly of the cutting edge 58 of punch 56 and the lower end of button die 52. During the upstroke of assembly 16, the knockout bar 106 contacts stop bar 100 which slides in slot 101 as it contacts stop elements 108 to push spider element 80 and knockout pins 88 against the top end of knockout 68 extending knockout 68 downwardly to a second position in which its lower end extends beyond the cutting edge 58 of punch 56 and the lower end of button die 52 so that the stamped product is separated from the button die and the punch.

The improved die set provides a means for replacing knockout pins 88 after the upper shoe 14 has been detached from the reciprocating assembly 16 by removal of bolts 18. The knockout bar 106 is first lifted out of bushing 98. The bushing is then lifted out of engagement with spider shank 86 so that spider element 80 can be removed from the reduced area 82 of recess 50. The knockout pins 88 can then be lifted out of backing plate 76. Replacement knockout pins 88 are substituted and the upper shoe 14 is reassembled. This provides a unique structure for replacing knockout pins without removing the die retainers and dies from the shoe which necessarily would require a time consuming realignment process.

The embodiments of the invention in which an exclusive property or privilege is claimed are defined as follows:

1. An improved die set for attachment to the upper reciprocating assembly of a vertical stamping press for producing stamped products, said press having a frame mounting a stationary die member, said reciprocating assembly above said stationary die member and a stop element comprising, in combination: an upper shoe having means for rigid attachment to said reciprocating assembly and a recess opening downwardly in the lower face thereof, generally in line with said stationary member; a die retainer mounted on the lower face of said shoe with its central aperture in line with said shoe recess; a button die removably mounted in the central aperture of said die retainer; a punch removably mounted in said recess within said button die in axial alignment with said stationary die member, said punch having a cutting surface at its lower end and a cylindrical body portion extending upwardly above said button die, a punch retainer mounted in said recess above said button die and having a bore in which the cylindrical body portion of said punch is located; a stamped product knockout surrounding said punch in the space between said punch and said button die; a backing plate mounted in said recess in contact with upper surface of said punch retainer; a spider element located in said recess above said backing plate having a radially extending contact portion and a shank portion extending axially from the top of said upper shoe; a plurality of knockout pins, each extending through holes in said punch retainer and backing plate, with the upper end of each pin in contact with the contact portion of said spider element, and the lower end of each pin in contact with the top of said knockout; a bushing located on the top of said shoe within which the shank portion of said spider element extends; a stop bar slidably mounted on said reciprocating assembly above said bushing and in line with said spider shank; a stop element mounted on said frame above said bushing and in line with said stop bar; and a knockout bar extending out of said bushing in line and contact with the shank portion of said spider element and said stop bar; whereby as said assembly is reciprocated in a stamping cycle, said knockout slides from a first position during the downstroke of said assembly wherein the lower end of said knockout is withdrawn upwardly of the lower ends of said punch and said button die, and during the upstroke of said assembly said stop bar contacts said stop element to push said knockout bar, said spider element, said knockout pins and said knockout downwardly, to a second position in which the lower end of said knockout extends beyond the lower ends of said punch and button die for separation of said stamped product from said button die and punch; and wherein said knockout pins can be replaced by the procedure of detaching said upper shoe from said reciprocating assembly, lifting said knockout bar out of said bushing and moving said bushing out of engagement with said spider element shank and lifting said spider element from said recess so that said knockout pins can be lifted from above said backing plate through said recess, and replacement knockout pins can be substituted by reversing said procedure.

2. The improved die set according to claim 1 wherein said knockout pins have collar portions adjacent their upper ends with a chamfer, and the holes through said backing plate are chamfered on the top side of said plate to receive said pin chamfer.

3. The improved die set according to claim 1 wherein the radially extending contact portion of said spider element comprises a plurality of radially extending arms.

4. The improved die set according to claim 3 wherein the upper portion of said recess has a reduced dimension preventing removal of said backing plate from the top end of said shoe while permitting the removal of said spider element from the top end of said shoe.

5. The improved die set according to claim 4 wherein the reduced upper portion of said recess is formed with a plurality of radially extending lobe cutouts to accommodate the plurality of radially extending spider arms.

6. The improved die set according to claim 1 wherein said knockout has an outwardly extending flange at its upper end, said button die has an upward extending cavity portion accommodating said knockout flange, and further comprising a resilient member fitted over the lower end of said knockout acting between knockout flange and said button die to retain said knockout in said first position.

7. The improved die set according to claim 1 wherein the means for attaching said upper shoe to said reciprocating assembly comprises a plurality of machine screws.

* * * * *